US005250987A

United States Patent [19]

Gern

[11] Patent Number: 5,250,987

[45] Date of Patent: Oct. 5, 1993

[54] TONER MONITOR TO CONTROL DEVELOPMENT CONCENTRATION AND LOCATE DEVELOPER STATIONS WITH RESPECT TO A STATIONARY PHOTO-CONDUCTOR IN AN ELECTROPHOTOGRAPHIC APPARATUS

[75] Inventor: Steven M. Gern, Rochester, N.Y.

[73] Assignee: Eastman Kodak Company, Rochester, N.Y.

[21] Appl. No.: 917,655

[22] Filed: Jul. 23, 1992

[51] Int. Cl.[5] ..... G03G 21/00

[52] U.S. Cl. ..... 355/208; 118/689; 355/246; 355/326

[58] Field of Search ..... 118/689, 691; 355/208, 355/245, 246, 326, 327

[56] References Cited

U.S. PATENT DOCUMENTS

| | | | |
|---|---|---|---|
| 4,358,195 | 11/1982 | Kuehnle et al. | 355/327 |
| 4,615,612 | 10/1986 | Ohno et al. | 355/245 |
| 4,754,302 | 6/1988 | Komatsubara et al. | 355/298 |
| 4,797,704 | 1/1989 | Williams et al. | 355/260 |
| 4,801,966 | 1/1989 | Ikeda | 355/245 |
| 4,884,109 | 11/1989 | Hill et al. | 355/260 |
| 4,912,491 | 3/1990 | Hoshino et al. | 346/160 |
| 4,922,302 | 5/1990 | Hill et al. | 355/251 |
| 4,939,548 | 7/1990 | Yamada et al. | 355/245 |
| 4,965,597 | 10/1990 | Ohigashi et al. | 346/157 |
| 4,999,676 | 3/1991 | Mouri | 355/246 |
| 5,031,004 | 7/1991 | Borostyan | 355/327 |
| 5,053,820 | 10/1991 | Preszler et al. | 355/245 |
| 5,070,362 | 12/1991 | Noda | 355/245 X |
| 5,083,164 | 1/1992 | Kamath et al. | 355/245 |
| 5,111,245 | 5/1992 | DeCecca et al. | 355/245 |
| 5,142,325 | 8/1992 | Kai et al. | 355/208 X |
| 5,146,278 | 9/1992 | Kroll et al. | 355/245 X |
| 5,164,775 | 11/1992 | Miller et al. | 355/246 |

FOREIGN PATENT DOCUMENTS 0127672 5/1990 Japan .

*Primary Examiner*—A. T. Grimley
*Assistant Examiner*—Robert Beatty
*Attorney, Agent, or Firm*—Dennis R. Arndt

[57] ABSTRACT

An applicator for a development unit is precisely positioned with respect to an image member, such as a photoconductive drum. The signal strength of the toner monitor is used to accurately locate each developer unit under a stationary photoconductor. The incremental distance from a home position required to position each development unit precisely under a stationary photoconductor is placed in a non-volatile memory so that the information can be used to control the drive motor to repeat the precise positioning at a later time.

13 Claims, 5 Drawing Sheets

TONER MONITOR TO CONTROL DEVELOPMENT CONCENTRATION AND LOCATE DEVELOPER STATIONS WITH RESPECT TO A STATIONARY PHOTO-CONDUCTOR IN AN ELECTROPHOTOGRAPHIC APPARATUS

BACKGROUND OF THE INVENTION

1. Technical Field

This invention relates to the control of toner concentration used in electrophotographic marking engines and more particularly, in using the signal strength of the toner monitor to accurately locate each developer station with respect to a stationary photo-conductor.

2. Background Art

With the development of electrostatographic marking engines using more than one color, the need arises to monitor and control the toner concentration in more than one development mixture. In an effort to minimize manufacturing costs, considerable engineering effort continues on developing cost effective solutions at uncompromised performance. To this end, it has been proposed that cost-effective control of toner concentrations in more than one development mixture can be accomplished by using only one toner monitor. See, for example, commonly assigned U.S. patent application Ser. No. 07/632,677, now U.S. Pat. No. 5,192,972, filed in the names of A. S. Kroll and W. Chang on Dec. 24, 1990.

U.S. Pat. No. 4,928,146, issued to Yamada on May 22, 1990 is illustrative of a number of references which show the development of a series of electrostatic images carried on a photoconductive drum with different colored toners at a single development position. See also U.S. Pat. No. 3,797,930, Tanaka et al, issued Mar. 17, 1974; U.S. Pat. No. 4,275,134, Knechtel, issued Jun. 23, 1981; Japanese Koki 1-244477 (1989); U.S. Pat. No. 4,728,983, Zwaldo, issued Mar. 1, 1988. A series of four development units are moved one after another to the development position. Each unit develops an image and is replaced by another unit as the series of units is indexed to apply a different color toner to the next image. The series of units are arranged side-by-side and moved linearly through a position in which the unit to be used is aligned with the development zone. When aligned or slightly before, a cam is rotated to push the entire unit toward the development zone, generally moving transverse to the motion of the series of units.

Other references such as U.S. Pat. No. 4,615,612 discloses color image-forming apparatus wherein a plurality of image developing units are supported on a turret which rotatably indexes the units to move a desired unit to a position for developing an image on a photoconductor. The position of a developing unit is detected and compared with a predetermined target position. A controller controls the speed and position of the turret for accurately positioning a desired developing unit. Data tables are used to stored target positions corresponding to constant time increments.

This general approach has the advantage of utilizing only a single development position for applying four different color toners to electrostatic images. This permits the use of development units whose size and number would prohibit them being spaced around the periphery of a relatively small photoconductive drum. It thus also permits the use of a small photoconductive drum. The use of a small drum has many advantages such as reduced expense and reduced size of the apparatus.

In most of these apparatus, a drum photoconductor is permanently fixed in the apparatus as the supporting structure for each development unit. With such structure, critical positioning of each development unit with respect to the photoconductive drum can be managed by precise manufacturing and assembly of those parts and their supporting structure. It would be desirable to remove the need for such precision.

U.S. Pat. Nos. 4,922,302, issued to Hill et al on May 1, 1990; 4,884,109, issued to Hill et al on Nov. 28, 1989; and 4,797,704, issued to Hill et al on Jan. 10, 1989, show a development station having an applicator with a rotating magnetic core and a stationary nonmagnetic sleeve around which a developer mixture is moved by rotation of the core to pass the developer through a development position. The applicator is fed by a rotating paddle positioned below the applicator which both mixes the developer and supplies it to the applicator. This particular structure requires that the applicator not be in contact with the image member carrying an electrostatic image to be developed, but that it be precisely spaced from it.

U.S. Pat. No. 4,801,966 is typical of a large number of references showing toning stations that are movable in an out of their own unique developer position to apply the correct color toner to the image being toned. Here, a developer applicator which is spaced from a photoconductive drum by a pair of rollers which engage the drum. This approach will provide accurate spacing only if other aspects of the relative position of the applicator and drum are precisely controlled.

Environmental parameters greatly impact the toner monitor readings, which is addressed in U.S. patent application Ser. No. 07/770.266, filed Oct. 3, 1991 in the name of Miller et al now U.S. Pat. No. 5,164,775. A reference block, which is made of a stable material used to compensate for the environmental parameters, requires accurate positioning. Each of the developer stations containing the development mixture require consistent and accurate positioning of the toner monitor, when a single toner monitor is used for multiple developer stations. A voltage signal received from the monitor varies as a result changes in toner concentration as well as to the location of the signal being measured. Variations in locating the toner monitor with respect to the developer stations and the reference block may reduce the validity of the measurements being received from the toner monitor. Statistically consistent measurements are necessary to obtain a functional system for measuring the toner concentration when implemented in a manufacturable product.

DISCLOSURE OF THE INVENTION

It is an object of the present invention to accurately position the developer units within the development zone using the toner monitor to identify a peak in the signal which corresponds to the desired position in the development zone.

Another object of the present invention is to provide a electrostatographic apparatus in which successive latent images recorded in a photoconductive member are developed with different color toner at a development zone, the apparatus comprising at least four developer units is adapted to move in unison with one another and each developer unit develops the latent image recorded on the photoconductive member with a different color toner Monitor means for producing a first signal representative of the concentration of toner particles in the developer unit when positioned in the development zone and a second signal that increases to a peak during movement of a developer unit into the development zone. There is positioning means responsive to the second signal to identify the peak in the second signal so as to accurately position the developer unit laterally within the development zone. There is also a drive means for moving the development units in an incremental fashion such as by using a stepper motor or a motor having an encoder connected thereto to provide uniform increments associated with the movement.

Once the positions of each developer unit has been accurately established using the monitor, the incremental distances from a start position to their respective positions in the development zone can be placed in computer memory for use at another time.

The invention and its objects and advantages will become more apparent in the detailed description of the preferred embodiments presented below.

BRIEF DESCRIPTION OF THE DRAWINGS

In the detailed description of the preferred embodiments of the invention presented below, reference is made to the accompanying drawings.

DETAILED DESCRIPTION OF THE PREFERRED EMBODIMENT

Figure 1:
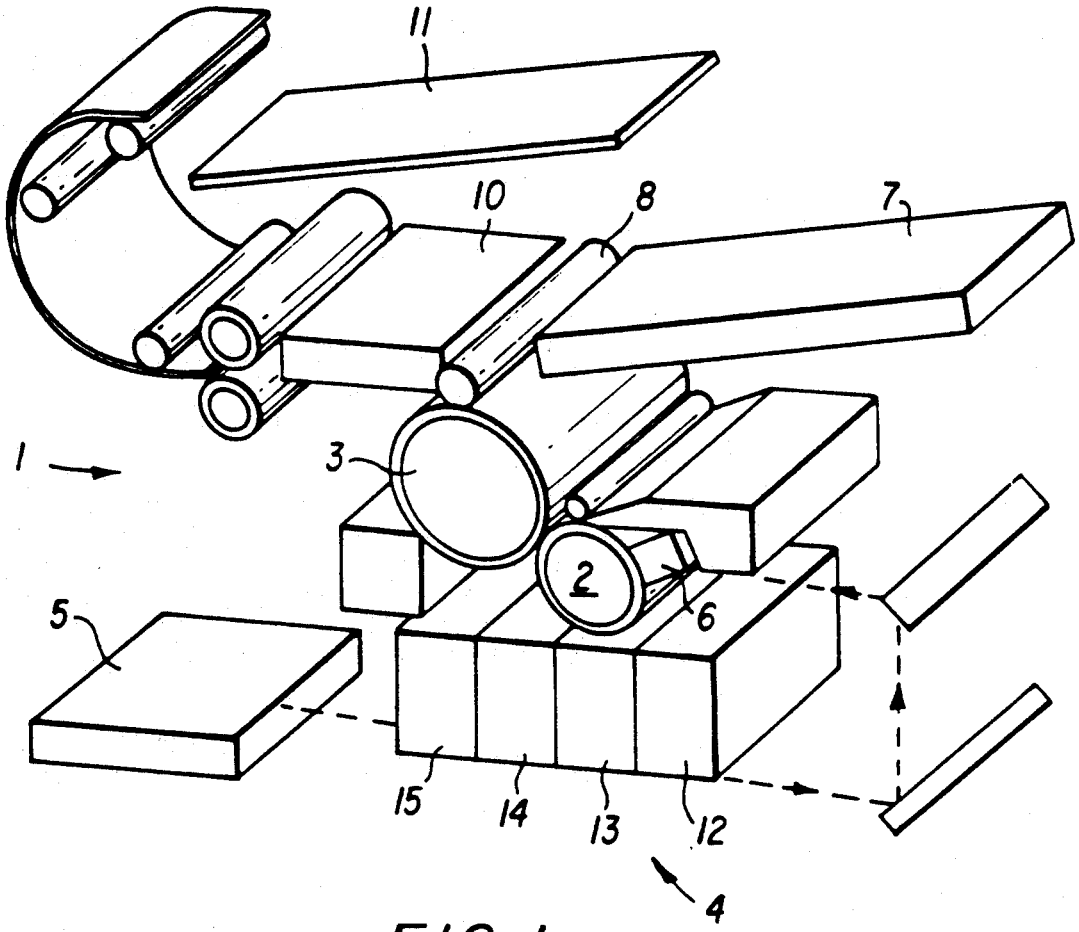
FIG. 1 is a front perspective view of an electrostatographic machine of the present invention.

According to FIG. 1, an electrophotographic color printer 1 includes a photoconductive drum 2 mounted for rotation past a series of stations to create multicolor tone images on transfer roller 3 or on a receiving sheet carried by transfer roller 3, according to a process well known in the art. More specifically, drum 2 is uniformly charged at a charging station 6, imagewise exposed at an exposure station, for example, by a laser exposure station 5, to create a series of electrostatic images.

The electrostatic images are developed by a development assembly 4, which applies a different color toner to each of the series of images to form a series of different color toner images. The series of toner images are then transferred in registration to a surface associated with transfer roller 3 to create a multicolor toner image. The surface associated with roller 3 can either be the surface of transfer roller 3 or the outside surface of a receiving sheet secured to the surface of roller 3. If the multicolor image is formed directly on the surface of transfer roller 3, it is best utilized by being transferred to a receiving sheet from a supply 7 at a position 8 remote from drum 2. The transferred image is fused at 10, and the finished sheet is stacked at 11.

A series of four development units 12–15 are moved through a development position allowing each of the electrostatic images to be toned by a different development unit but using only a single developing position associated with drum 2.

According to FIG. 1, the development units are all fixed in a laterally movable carriage supported on guide rails, not shown, for linear movement in a horizontal direction below drum 2.

Figure 2:
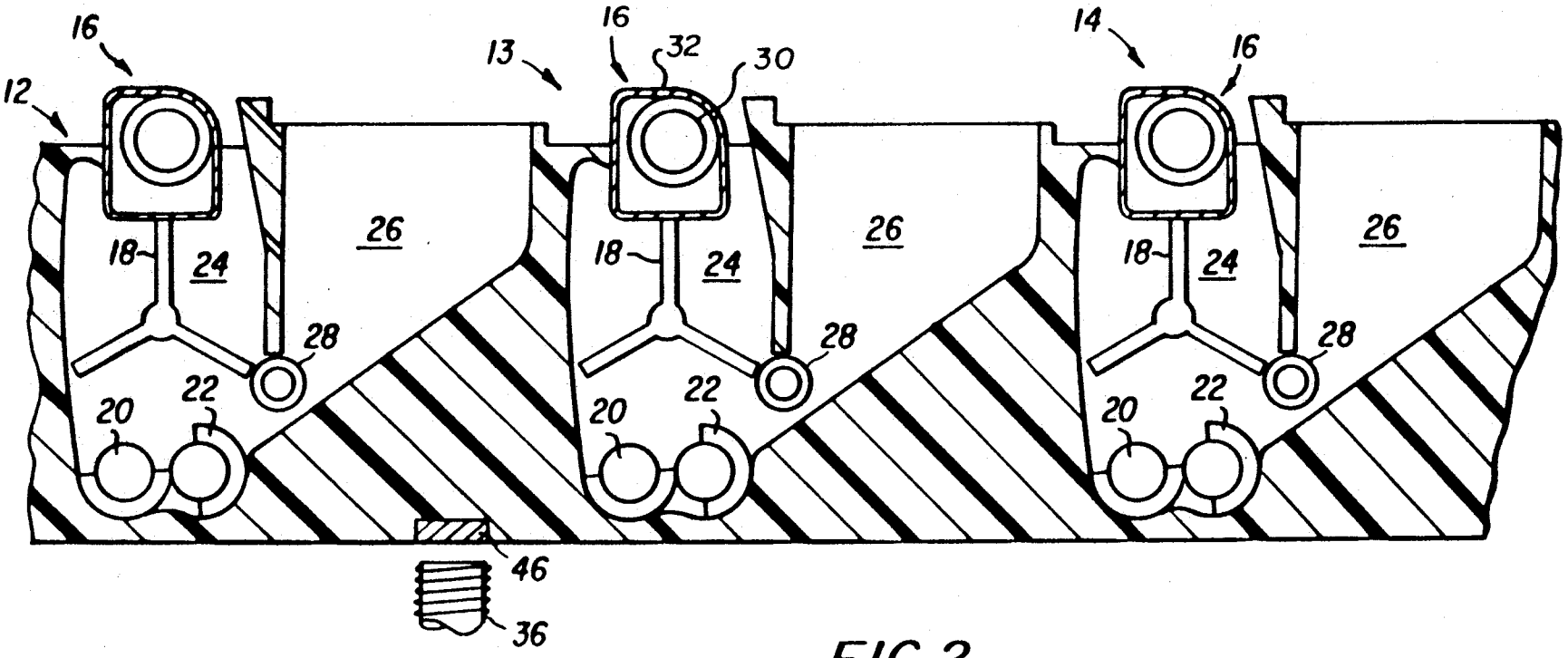
FIG. 2 is a rear cross-sectional view of more detailed showing of a development device usable in the electrostatographic machine shown in FIG. 1.

Referring to FIG. 2, a development unit 12 includes an applicator 16 and a mixing device such as paddle 18 and augers 20, 22. The mixing device is located in a development chamber 24 which contains a mixture of hard magnetic carrier particles and insulating toner particles. A supply of toner particles is contained in a toner chamber 26. Toner particles are fed from toner chamber 26 to development chamber 24 by a toner feed roller 28.

In operation, rotation of paddle 18 and augers 20, 22 cause both the mixing of developer in 24 and raising of the level of that developer making it accessible to the magnetic field applicator 16. Applicator 16 includes a rotatable magnetic core 30 and a stationary sleeve 32. Hard magnetic carrier particles move around sleeve 32 in response to rotation of core 30 bringing the developer through the developing position. The developer is moved by rotating core 30 at essentially the same speed as the electrostatic image is moving on rotating drum 2 providing high quality development of the electrostatic image.

A plurality of development units 12–15 which are of essentially the same construction, form development assembly 4 of FIG. 1. After development of a first electrostatic image, a motor, not shown, is actuated to drive development device 4 to the right, as illustrated, until applicator 16 of development unit 13 becomes aligned with the exposure position for toning a second electrostatic image. The process is repeated for development units 14 and 15. The motor is reversed after all four images have been toned, toning device 4 is returned to the left to its original position.

A toner monitor 36 is provided in a fixed position below development assembly 4 such that the development unit 12–15 which is at the developing position of drum 2 is aligned with toner monitor 36. Toner monitor 36 may be chosen from several commercially available products, such as, for example, those responsive to changes in effective permeability of two component developers and manufactured by Hitachi Metals, Ltd. Toner monitor 36 emits an analog signal which is representative of the permeability in the development mixture, and thus representative of the toner concentration.

As set forth above, variables associated with the measurement of the toner concentration in development units 12–15 can interject error in the output of toner monitor 36. According to the present invention, means are provided for calibrating the toner monitor to compensate for such variables.

A reference member 46 having known permeability is positioned in development assembly 4 such that member 46 aligns with toner monitor 36 as the development assembly shifts between its positions aligning development units 12 and development units 13 with the developing position. FIG. 2 shows the development assembly in its position aligning member 46 with the toner monitor. Member 46 simulates a nominal toner concentration to toner monitor 36. During start up, the output signal of toner monitor 36 when aligned with member 46 is stored in memory as a base value. From time to time during operation, the output signal of toner monitor 36 when aligned with member 46 is compared to the base value. Any difference between the output of the monitor and the base value is used to compensate future signals from toner monitor 36 accordingly.

Reference member 46 permits the detection of shifts of the output signal of toner monitor 36 caused by changing environment. The first reading for member 46 for each new development unit will be stored as a base value. The difference between the first reading and later reading will be added to or subtracted from the later reading of that station to compensate the output change of the sensor due to environment change.

In order to eliminate the temperature effects of the toner monitor, it is necessary for the reference member to have a stable, but not necessarily any particular (predefined) magnetic permeability. The permeability should, however, fall within the range of control voltages used to measure the permeability of the four development mixtures.

Figure 5:
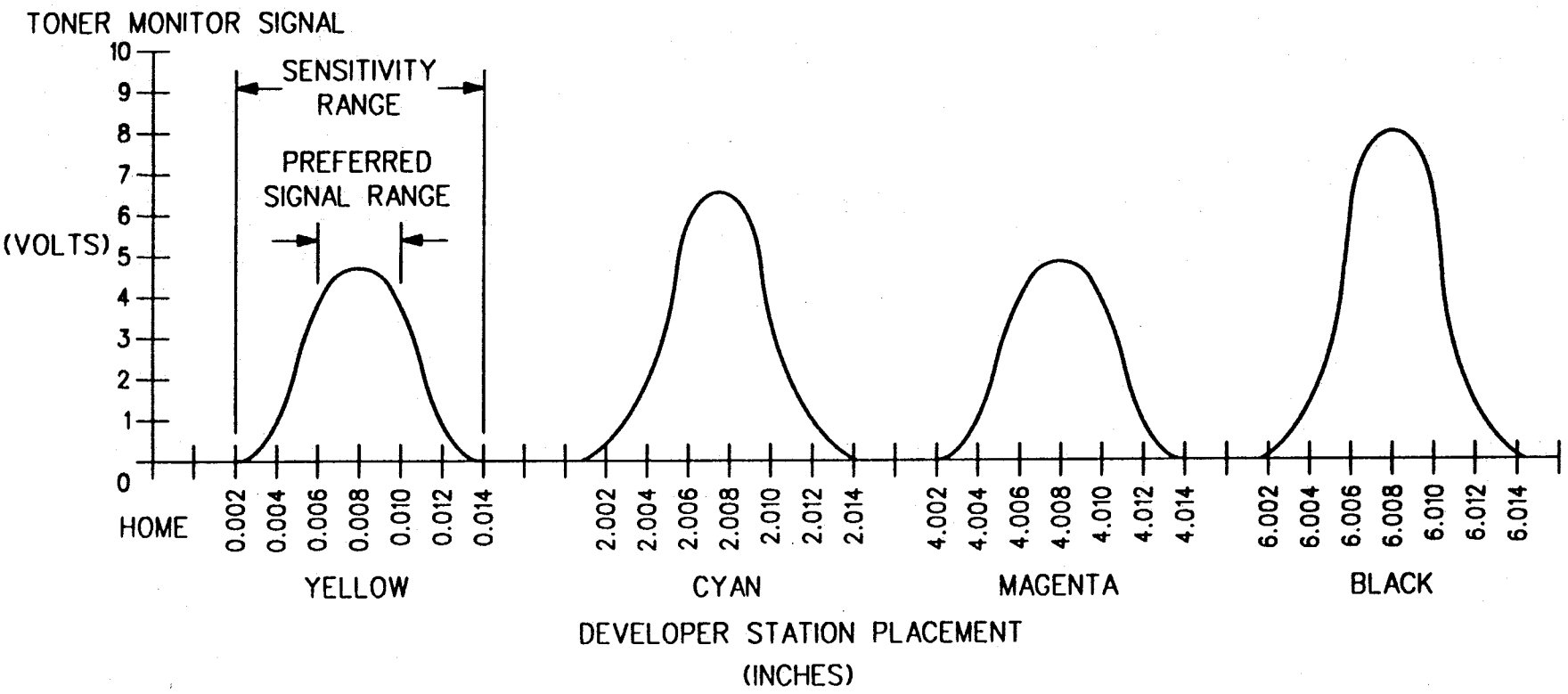
FIG. 5 is a graphical representation showing the magnitude of the toner monitor signal in volts with respect to lateral placement of the three developer stations in inches.

Referring to FIG. 2, the positioning of multiple developer units 12, 13, 14 and 15 is critical to the signal strength output of toner monitor 36. As the developer units move over toner monitor 36, the signal strength varies depending on their location. FIG. 5 graphically illustrates how the signal strength for each unit varies. Toner bottles (not shown) are positioned on top of each of the developer units and store a necessary reserve toner. During the electrophotographic process, toner is used in the image being printed and the development material stays in the developer unit. The toner concentration with respect to the development material must stay within a given range to consistently produce quality prints. In an effort to maintain its concentration, the toner is replenished as needed into toner chamber 26 by the print engine control logic. It is this concentration that is measured by toner monitor 36. The toner bottles are replaced by the customer as they are depleted. The development units are also replaced, primarily due to losses in required properties of the development material and not the amount of material. The toner monitor is sensitive to the development material when placed in close proximity, this known as the "Sensitivity Range". This is the overall range which the toner monitor senses any signal, no matter the strength. Within the "Sensitivity Range" is the "Preferred Signal Range". This is the range which has adequate signal strength to be applied to the electrophotographic process being performed and is the range used for positioning the developing units within the development zone.

The magnitude and range of sensitivity can vary due to properties in each of the materials used in the developer units. Locating or positioning the developer units with respect to the optimization of the signal being measured by toner monitor 36 removes mechanical error associated with placing sensors or optical flags as used in the past. Positioning the developer units within the development position using an optimal signal from the toner monitor and not to a predetermined physical location, allows the placement of the toner monitor to vary from machine to machine in manufacturing. However, this placement must not vary in any given machine after the insertion of the developer units and the calibration scan has taken place. Positioning the developer stations based on the optimum toner monitor signal is achieved by using a stepper motor controller for controlled movement of the developer units within the development zone. Use of a stepper motor controls motor rotation in small increments each time a pulse is applied to the input of the stepper motor sequencer. The frequency of the input signal (input pulses) determines the velocity of the stepper motor.

Figure 3:
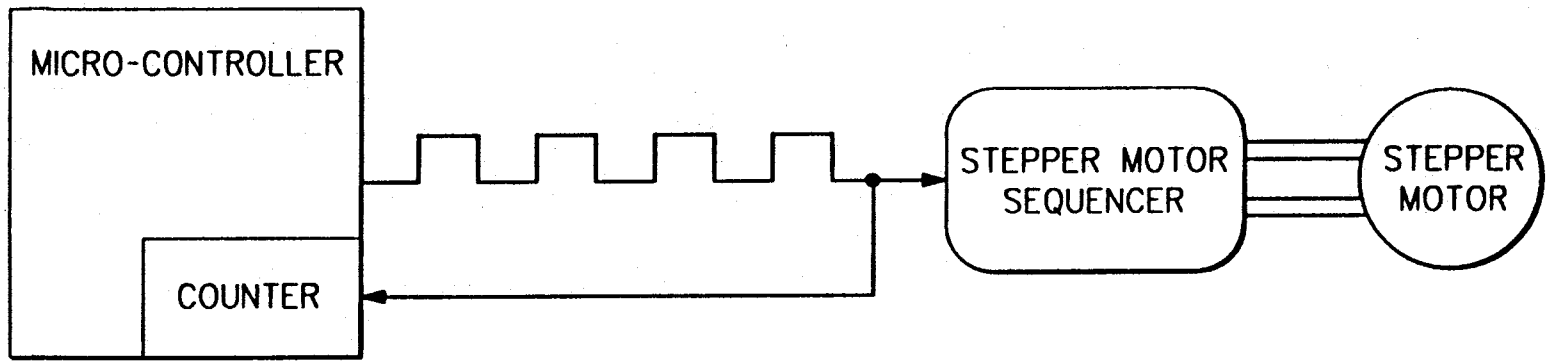
FIG. 3 illustrates the use of a micro-controller to control a stepper motor using a stepper motor sequencer to accurately move the developer unit from a home position to a location within the development zone.

Each time a new developer assembly 4 is installed in the color printer, the developer stations are slowly moved past toner monitor 36. Toner monitor 36 is continuously providing a signal as each developer unit passes. Simultaneously, the stepper motor pulses are counted from the home or rest position. The magnitude of the signal from the toner monitor is recorded by the control logic for each step of the stepper motor (FIG. 3). The control logic of this print engine can then determine the number of stepper motor pulses from home position required to locate each developer unit over the toner monitor within the development position the number of steps would correlate with the optimized (maximum) signals associated with each developer unit when properly positioned within the development position.

The number of steps from home to the development position for each developer unit is stored in a non-volatile memory to be recalled each time the machine is powered up. The stepper motor increments the number of required stepper pulses stored in memory associated with the development unit desired to be used in the development position. The motor moving the developer units laterally from home position in incremental steps when the correct count is reached, the development assembly is stopped, resulting in the desired developer unit being positioned in the development position. The stopping location can be maintained within the tolerance range of 0.003 inches. This is adequate to insure proper image registration for each of the development units in the multiple toning process required to create the finished print. The stepper motor count values are retained in memory until the print engine logic senses a new developer assembly has been installed and the positioning or calibration scan is once again performed and the new stepper motor count values are then placed into the non-volatile memory. The new scan is required for each specific developer assembly installed because of the unique characteristics of each developer unit. These unique characteristics are the result of manufacturing variations and changes in the material used.

Figure 4:
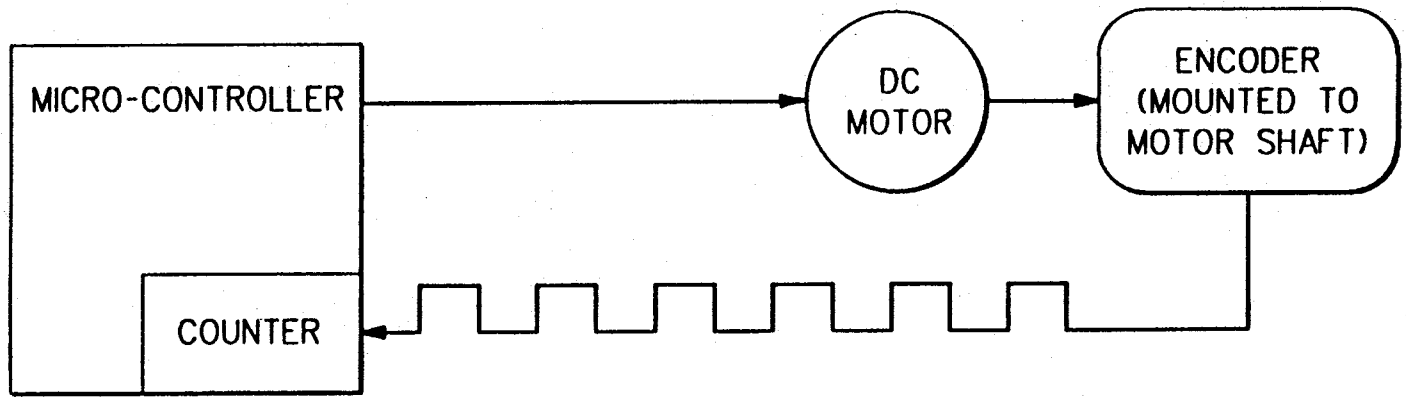
FIG. 4 illustrates the use of a micro-controller to control a D.C. motor having an encoder mounted to the motor shaft to accurately move the developer unit within the development zone from a home position.

It should be understood that an alternative embodiment could use an angular encoder in conjunction with the motor system that moves the developer units. In such an embodiment, the encoder would generate pulses back to the micro-controller or machine logic system. These pulses would be counted as before and the motor would once again be stopped (dynamically braked) at a desired count that corresponds to the developer unit required to be positioned in the developer position above the toner monitor. This embodiment is shown in FIG. 4.

The invention has described in detail with particular reference to a preferred embodiment thereof, but it will be understood that variations and modifications can be effected within the spirit and scope of the invention as described hereinabove and as defined in the appended claims.

I claim:

1. An electrostatographic apparatus in which successive latent images recorded on a photoconductive member are developed with different color toner at a development position, said apparatus comprising:

at least four developer units adapted to move in unison with one another, each developer unit develops the latent image recorded on the photoconductive member with a different color toner;

drive means for moving the development units laterally in an incremental fashion;

monitor means for producing a signal representative of the concentration of toner particles in the developer unit when positioned in the development positions during a set-up cycle that increases to a peak during movement of a developer unit into the development position; and positioning means responsive to said signal to identify the peak in said signal so as to accurately position the developer unit laterally within the development position.

2. An electrostatographic apparatus as set forth in claim 1 further comprising memory means for storing incremental information representative of the position of each developer unit in the development position from a known position.

3. An electrostatic apparatus as set forth in claim 2 wherein the incremental information takes the form of stepper motor counts from a known position.

4. An electrostatographic apparatus as set forth in claim 2 wherein the incremental information takes the form of encoder wheel pulses from a known position.

5. An electrostatographic apparatus as defined in claim 2 further comprising:

means operable in a stand-by mode after the set-up cycle for using the stored incremental information representative of the position of each developer unit in the development position from a known position; and drive means for moving the development units laterally in an incremental fashion using the stored incremental information to accurately position a selected developer unit within the development position.

6. A developing device for applying different color toners to different electrostatic images carried by the surface of a rotating drum as said drum moves through a single fixed development position, said development device comprising:

a plurality of development units, each unit containing a toner of a color different from the other units, said units being fixed in a side-by-side arrangement on a movable carriage, said carriage being movable in a lateral direction bringing each unit through a position in which it passes through the development position;

monitor means for producing signal indicating a peak when a selected development unit is aligned within the development position having a value representative of the concentration of toner particles in the developer mixtures of said aligned developing unit; and drive means for moving said carriage in incremental units and stopping said carriage in response to said peak signal thereby accurately aligning said development unit in the development position.

7. A developing device as defined in claim 6 further including means for simulating a predetermined toner concentration to said monitor means such that said monitor means produces a signal having a value corresponding to the predetermined toner concentration.

8. A developing device as set forth in claim 6 further comprising memory means for storing incremental information representative of the position of each developer unit in the development position from a known position.

9. A developing device as set forth in claim 8 wherein the incremental information takes the form of stepper motor counts from a known position.

10. A developing device as set forth in claim 8 wherein the incremental information takes the form of encoder wheel pulses from a known position.

11. An electrostatographic apparatus in which a developing device is used for applying toner to an electrostatic image carried on an image drum as said image moves through a development zone located generally at the bottom of said drum, said apparatus comprising:

a plurality of developer units, fixed in horizontal side-by-side relation on a movable development assembly each unit having a development chamber for holding two-component developer, means for mixing developer in said chamber and an applicator at the top of the chamber for presenting developer to a development position above said unit;

means for driving said development assembly through a generally horizontal path to move each unit, one after another, incrementally through a position directly below the development position of said drum;

monitor means for producing a signal representative of the concentration of toner particles in the development unit when positioned in the development position that increases to a peak during movement of a developer unit into the development position; and positioning means responsive to said signal so as to accurately position the developer unit within the development position in response to the peak in said signal.

12. An electrostatographic apparatus as set forth in claim 11 which further includes means for simulating a predetermined toner concentration to said monitor means such that said monitor means produces a signal having a value corresponding to a predetermined toner concentration.

13. An electrostatographic apparatus as set forth in claim 11 which further includes a control means for controlling the drive means to drive said development assembly from a start position in a first direction and to stop said development assembly with each unit directly below said development position for enough time for each unit to develop a single electrostatic image carried by said drum and after all units have developed an electrostatic image to move said development assembly back to said start position.

* * * * *